US011229579B2

(12) United States Patent
Dufour et al.

(10) Patent No.: US 11,229,579 B2
(45) Date of Patent: Jan. 25, 2022

(54) LAYERED MULTIPLE SINGLE-DOSE MEDICATION SYSTEMS AND ASSEMBLIES

(71) Applicants: Brian Dufour, Kernersville, NC (US); Cecil Davis, Winston-Salem, NC (US)

(72) Inventors: Brian Dufour, Kernersville, NC (US); Cecil Davis, Winston-Salem, NC (US)

( * ) Notice: Subject to any disclaimer, the term of this patent is extended or adjusted under 35 U.S.C. 154(b) by 0 days.

(21) Appl. No.: 15/525,440

(22) PCT Filed: Nov. 11, 2015

(86) PCT No.: PCT/US2015/060120
§ 371 (c)(1),
(2) Date: May 9, 2017

(87) PCT Pub. No.: WO2016/077439
PCT Pub. Date: May 19, 2016

(65) Prior Publication Data

US 2018/0289589 A1 Oct. 11, 2018

Related U.S. Application Data

(60) Provisional application No. 62/078,120, filed on Nov. 11, 2014.

(51) Int. Cl.
*A61J 7/00* (2006.01)
*A61J 1/03* (2006.01)

(52) U.S. Cl.
CPC ..... *A61J 7/0069* (2013.01); *A61J 1/035* (2013.01); *A61J 7/0076* (2013.01); *A61J 7/0084* (2013.01); *A61J 2205/30* (2013.01)

(58) Field of Classification Search
CPC ..... A61J 1/035; A61J 7/0069; A61J 7/0076; A61J 7/0084; A61J 2205/30; A61M 2205/6045; A61M 2206/16; B65D 75/36; B65D 75/38; B65D 75/366; B65D 77/04; B65D 83/0445; B65D 83/0463; B65D 2575/3263
See application file for complete search history.

(56) References Cited

U.S. PATENT DOCUMENTS 3,246,746 A * 4/1966 Holley ..... B65D 73/0092 206/462
3,659,706 A * 5/1972 Serrell ..... B65D 83/0445 206/445
4,429,792 A * 2/1984 Machbitz ..... B65D 75/327 206/531
5,014,851 A 5/1991 Wick ..... 206/539
(Continued)

*Primary Examiner* — Gene O Crawford
*Assistant Examiner* — Kelvin L Randall, Jr.
(74) *Attorney, Agent, or Firm* — MacCord Mason PLLC

(57) ABSTRACT

Devices, assemblies, and methods for arranging and dispensing medication are shown and described. In one embodiment, a medication dispensing assembly includes a first single dose tray having a plurality of dosage complexes and a first label face, and at least a second single dose tray having a plurality of dosage complexes and a second label face. Each dosage complex has a unitary blister pocket adjacent to an L-shaped opening. In other embodiments, a single dose medication tray includes a label platform and a plurality of dosage complex groupings. The result is devices and methods to orient and dispense individually packaged medications.

13 Claims, 11 Drawing Sheets

(56) References Cited

U.S. PATENT DOCUMENTS

| | | | | |
|---|---|---|---|---|
| 5,050,739 | A * | 9/1991 | Hannan | A61J 1/035 206/531 |
| 6,253,920 | B1 * | 7/2001 | Kallgren | B65D 75/327 206/532 |
| 6,540,081 | B2 | 4/2003 | Balz et al. | 206/531 |
| 7,293,653 | B2 * | 11/2007 | Von Falkenhausen | B65D 75/327 206/532 |
| 7,971,414 | B1 | 6/2011 | McGonagle et al. | 53/246 |
| 8,291,679 | B2 * | 10/2012 | Bourque | A61J 1/03 206/539 |
| 8,700,212 | B1 | 4/2014 | Bruno et al. | 700/242 |
| 2002/0045184 | A1 * | 4/2002 | Chen | A61J 1/035 435/6.16 |
| 2005/0051454 | A1 | 3/2005 | Coe et al. | 206/536 |
| 2005/0237222 | A1 * | 10/2005 | Bogash | A61J 1/035 340/870.07 |
| 2008/0035520 | A1 | 2/2008 | Caracciolo et al. | 206/531 |
| 2009/0139893 | A1 * | 6/2009 | McGonagle | A61J 1/035 206/531 |
| 2011/0168578 | A1 | 7/2011 | Brunner | 206/63.5 |
| 2011/0198261 | A1 | 8/2011 | Kurtze et al. | 206/531 |
| 2012/0060450 | A1 | 3/2012 | Burns et al. | 53/467 |
| 2012/0305584 | A1 * | 12/2012 | Carson | A61J 1/03 221/1 |
| 2014/0216968 | A1 | 8/2014 | Wagner et al. | 206/438 |
| 2015/0014203 | A1 * | 1/2015 | Upchurch | A61J 1/035 206/462 |
| 2016/0122119 | A1 * | 5/2016 | van Esch | B65D 75/326 206/462 |
| 2019/0125132 | A1 * | 5/2019 | Powers | A47J 42/34 |

* cited by examiner

LAYERED MULTIPLE SINGLE-DOSE MEDICATION SYSTEMS AND ASSEMBLIES

This application claims the benefit to PCT/US15/60120, filed Nov. 11, 2015, which claims priority to U.S. provisional application No. 62/078,120, filed Nov. 11, 2014, all of which are herein incorporated by reference in their entireties.

FIELD OF THE TECHNOLOGY

The present disclosure relates generally to medication dosing, and more particularly to improved devices, systems, and methods of assembling and dispensing multiple single-dose medications.

BACKGROUND

Medication dispensers often address numerous issues associated with medicine compliance. For instance, single-dose dispensing systems may involve a single medication with one or more tablets or capsules in a dosage pocket. Typically, the user, i.e. the patient, health care provider, or the like, pierces the covering of the pocket in order to remove the medication. For users with multiple medications, this packing system requires that a separate dispensing system be present for each medication. One problem associated with these traditional systems and methods is that the separate dispensing system may lead to compliance issues, for instance if a user forgets to take one of the medications.

There are also presently commercially available multiple-dose dispensing systems. These systems typically involve two or more medications packaged in a dosage pocket. Again, the user pierces the covering of the pocket in order to remove the medications. However, for users with multiple medications, this packing system is problematic under several scenarios. For instance, traditional multiple-dose dispensing systems require a static medication regimen. The traditional multiple-dose dispensing systems are not flexible to address one or more medication changes. For instance, when there is a change to medication, and/or when a new medication dosage is added to the regimen, and/or when one of the grouping of medications is removed from the regimen, the traditional multiple-dose dispensing systems are problematic. Under these scenarios, the medications may not easily be removed from the packaging by the user, for example without the involvement of skilled medical personnel.

Therefore, Applicants desire devices, systems, and methods for visually arranging and dispensing medication, without the drawbacks presented by the traditional systems and methods.

SUMMARY

In accordance with the present disclosure, devices and assemblies are provided for storing and dispensing medication. This disclosure provides improved devices, systems, and methods that are convenient, comfortable, and safe for the user, particularly when used to dispense multiple single-dose medications.

In one embodiment of the disclosure, a multidose medication dispensing system comprises a first single dose tray and at least a second single tray, wherein said first tray includes a bottom surface and said second tray includes an upper surface, and wherein said second tray's upper surface protrudes through said first tray's bottom surface to interface in a removably layered interconnected module to define a multi-dose packaging. The first single dose tray has a plurality of dosage complexes and a first label face, wherein each of said dosage complexes having a unitary blister pocket adjacent to an alignment opening. The at least a second single dose tray has a plurality of dosage complexes and a second label face, wherein each of said dosage complexes having a unitary blister pocket adjacent to an alignment opening.

In some examples, the system includes a third single dose tray having a plurality of dosage complexes and a third label face. Further, another example includes a fourth single dose tray having a plurality of dosage complexes and a fourth label face.

In certain examples the first tray's blister pocket includes a first single dose medication and said second tray's blister pocket has a second single dose medication distinct from said first dose medication. The dosage complex may include an outer wall and said pocket blister includes an inner wall. The first tray and said second tray each may include four groupings of dosage complexes adapted to correspond to a seven day week regimen. In alternative examples, the first tray and said second tray each include groupings of dosage complexes adapted to correspond to a fourteen day regimen.

In particular examples, the label face is adjacent to an exposed portion. The device may include a frame having a patient and medication description area. The first tray's unitary blister pocket may be a first dimension, while the second tray's unitary blister pocket may be a second dimension distinct from said first dimension.

In some examples, the unitary blister pocket may be adjacent to an independent sized alignment opening. In alternative examples, the unitary blister pocket may be adjacent to an L-shaped alignment opening. Further, the second tray may be aligned substantially ninety degrees from said first single dose tray in said interconnected module.

Another embodiment of the present disclosure includes a single dose medication tray having a label platform and a first, second, third, and fourth dosage complex grouping. The label platform typically has at least one label face and at least one adjacent exposed portion. The first, second, third, and fourth dosage complex grouping each typically have a plurality of unitary blister pockets adjacent to an opening and positioned around the periphery of the label platform. Typically, the first and second groupings oppose one another and the third and fourth groupings oppose one another and the first and second groupings being substantially perpendicular to the third and fourth groupings.

In some examples, the blister pockets extend from a top face of the tray. The blister pockets may be equal size rectangular prisms. The label platform may be centered on the tray. The label platform's exposed portion may be L-shaped. The blister pocket may include an opening flush with a rear face of the tray. A punctureable seal may temporarily seal the opening. Each dosage complex may include four quadrants, and the blister pocket may be positioned in one quadrant.

In particular examples, the blister pocket may be positioned in an upper left quadrant. Each individual dosage complex may include a proximate corner adjacent the label face. Each individual dosage complex may include an outer wall and the pocket blister includes an inner wall. Each dosage complexes may be separated into four groupings. The tray may include twenty-eight blister pockets.

In some examples, the tray may include a single dose medication. For instance, the single dose medication may be an oral medication, for instance a solid or a semi-solid medication.

Another embodiment of the disclosure is a multiple single-dose medication dispensing system having a first single dose tray and at least a second single dose tray. The first single dose tray has a plurality of dosage complexes and a first label face. Each of the dosage complexes have a unitary blister pocket adjacent to an L-shaped opening. The second single dose tray has a plurality of dosage complexes and a second label face. Again, each of the second tray's dosage complexes have a unitary blister pocket adjacent to an L-shaped opening. Typically, the first single dose tray is removably fastened to the second single dose tray.

In particular examples, the first tray includes a bottom surface and the second tray includes an upper surface, and wherein the second tray's upper surface protrudes through the first tray's bottom surface to interface in a layered interconnected module. The second tray may be aligned substantially ninety degrees from the first single dose tray in the interconnected module. Further, the system may have a third single dose tray having a plurality of dosage complexes and a third label face. The third tray may be aligned substantially ninety degrees from the second single dose tray in a layered interconnected module. In addition, the tray may include a fourth single dose tray having a plurality of dosage complexes and a fourth label face. The fourth tray may be aligned substantially ninety degrees from the third single dose tray in the interconnected module.

In certain examples, the first tray's blister pocket includes a first single dose medication and the second tray's blister pocket includes a second single dose medication distinct from the first dose medication. The single dose medication may be an oral medication. The blister pocket may include an opening flush with a rear face of the tray. The tray may include a punctureable seal temporarily sealing the opening. Each of the dosage complex may include four quadrants, and the blister pocket may be positioned in one quadrant. Typically, the blister pocket is positioned in an upper left quadrant. Further, an L-shaped opening may comprise all remaining quadrants adjacent the blister pocket. The L-shaped opening may be positioned in a bottom-left, bottom-right, and top-right quadrant.

In particular examples, the dosage complex includes a proximate corner adjacent to the label face. Further, the dosage complex may include an outer wall and the pocket blister may include an inner wall. The first tray and the second tray each may include four groupings of dosage complexes corresponding to a seven day week regimen. The first tray and the second tray each may include twenty-eight blister pockets. The label platform may be centered on the tray. The label face may be adjacent to an exposed portion. The label face may be adjacent to an L-shaped exposed portion.

In some examples, the system may include a frame, for instance a frame that encloses the first tray and the second tray. The frame may include a patient and/or medication description area.

In yet another embodiment, a medication storage assembly includes a first single dose tray, a second single dose tray, a third single dose tray, and a fourth single dose tray. The first single dose tray has a plurality of dosage complexes positioned around a periphery of a first label face, wherein each of the dosage complexes has a blister pocket adjacent to an opening. Further, at least one medication is removably sealed in at least one of the first tray's blister pockets. The second single dose tray has a plurality of dosage complexes positioned around a periphery of a second label face, wherein each of the dosage complexes has a blister pocket adjacent to an opening. Typically, the second tray is removably mechanically engaged, i.e. layered, substantially ninety degrees from the first tray. Further, at least one second medication is removably sealed in at least one of the second tray's blister pockets. The third single dose tray has a plurality of dosage complexes positioned around a periphery of a third label face, wherein each of the dosage complexes having a blister pocket adjacent to an opening. Typically the third tray is removably layered substantially ninety degrees from the second tray. Further, at least one third medication is removably sealed in at least one of the third tray's blister pockets. The fourth single dose tray has a plurality of dosage complexes positioned around a periphery of a fourth label face, wherein each of the dosage complexes having a blister pocket adjacent to an opening. Typically the fourth tray being removably layered substantially ninety degrees from the third tray. Further, at least one fourth medication is removably sealed in at least one of the fourth tray's blister pockets.

In certain examples, at least one of the first, second, third, and fourth single dose tray is removable from the assembly. Further, at least a second of the first, second, third, and fourth single dose tray may be removable from the assembly. At least one of the medications may be distinct from the other medications. The single dose medication may be solid and/or semi-solid daily oral medications as recognized by those skilled in the art. Each blister pocket may include an opening that is flush with a rear face of the tray. The assembly may include a punctureable seal that is temporarily sealing the opening. Each of the dosage complexes may include four quadrants, and the blister pocket may be positioned in one quadrant. The blister pocket may be positioned in an upper left quadrant.

In certain examples, each dosage complex includes a proximate corner adjacent to the label face. Each dosage complex may include an outer wall, and the pocket blister may include an inner wall. Each tray may include four groupings of dosage complexes corresponding to a seven day week regimen. Further, each tray may include twenty-eight blister pockets. In addition, each of the label platform may be centered on each the tray. Each label face may be adjacent to an exposed portion. Each label face may be adjacent to an L-shaped exposed portion. Each blister pocket may be equal size rectangular prisms.

In particular examples, the assembly includes a frame enclosing the first tray, second tray, third tray, and fourth tray. The frame may include a patient and/or medication description area.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended examples and claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
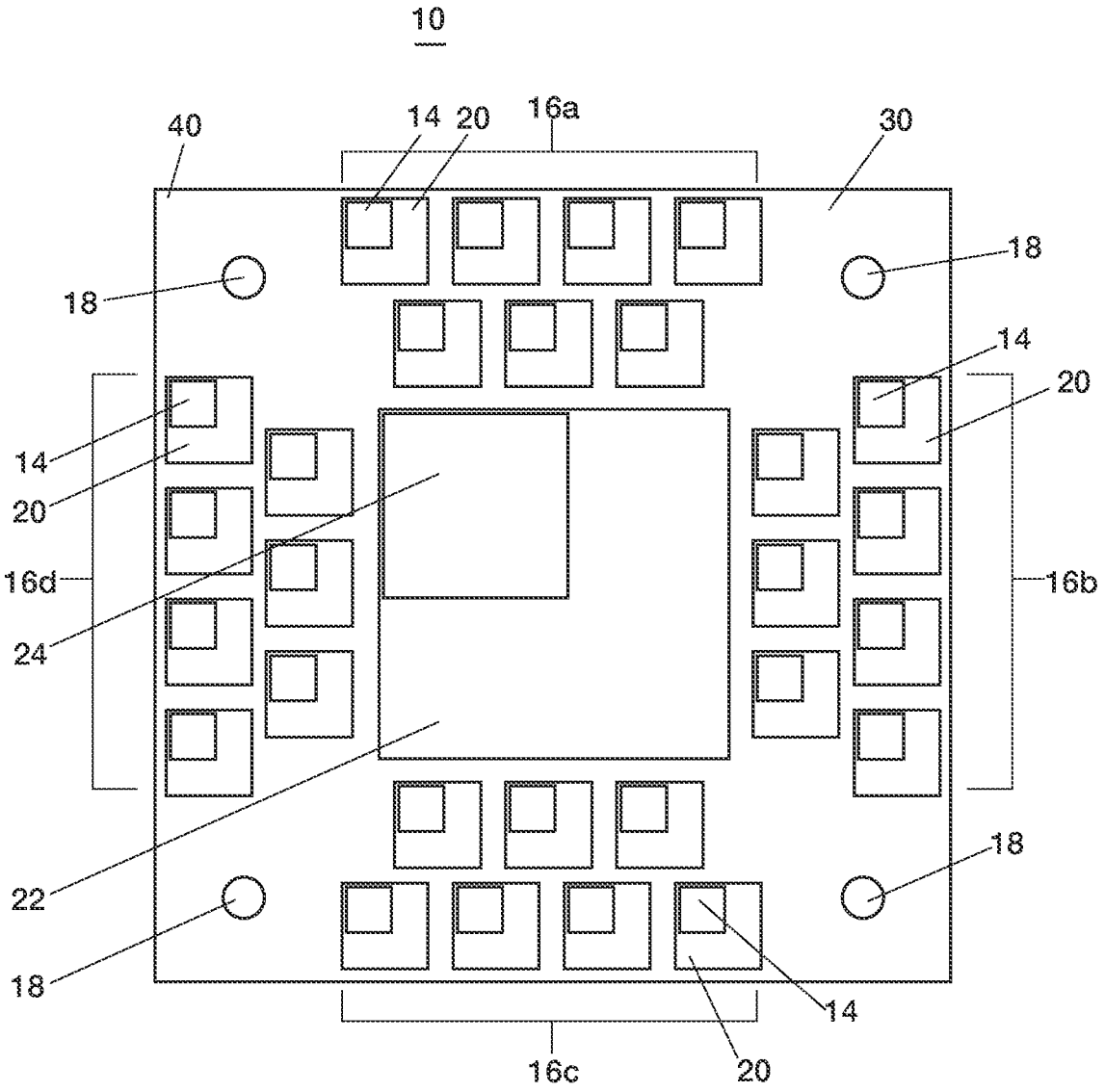
FIG. 1 is a front schematic view of a medication dosage display and dispensing system according to an embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 9:
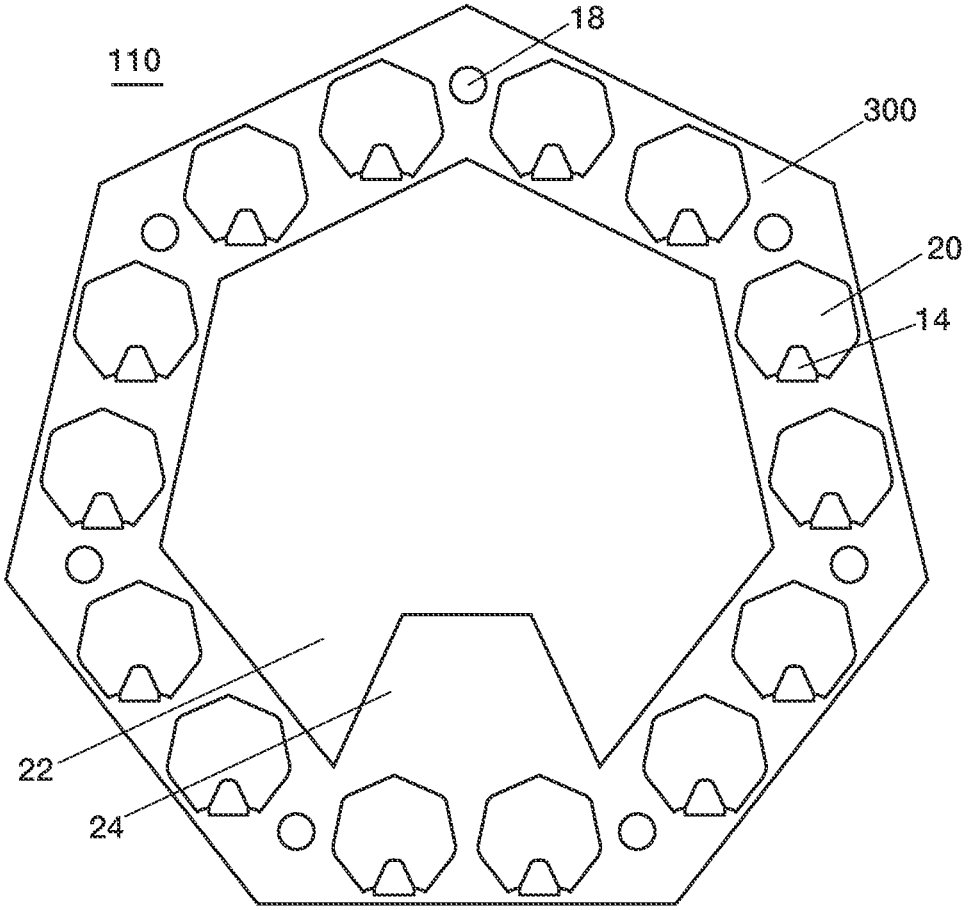
FIG. 9 is a top view of a medication dosage display and dispensing system according to an alternative embodiment of the disclosure.
Figure 10:
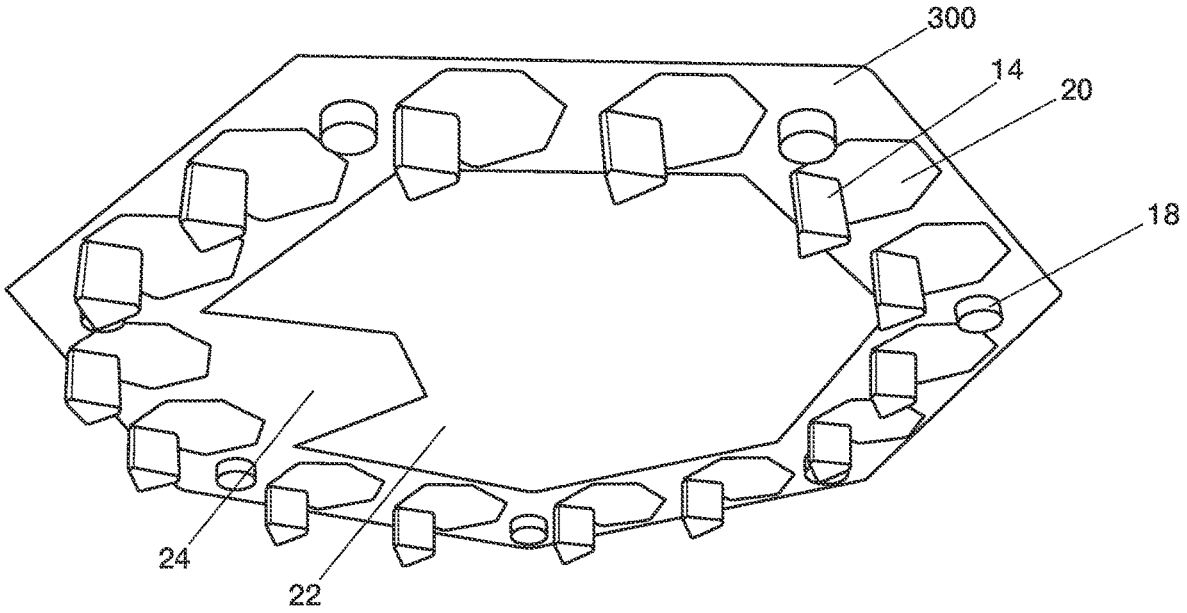
FIG. 10 is a side perspective view of the tray elements introduced in FIG. 9.
Figure 11:
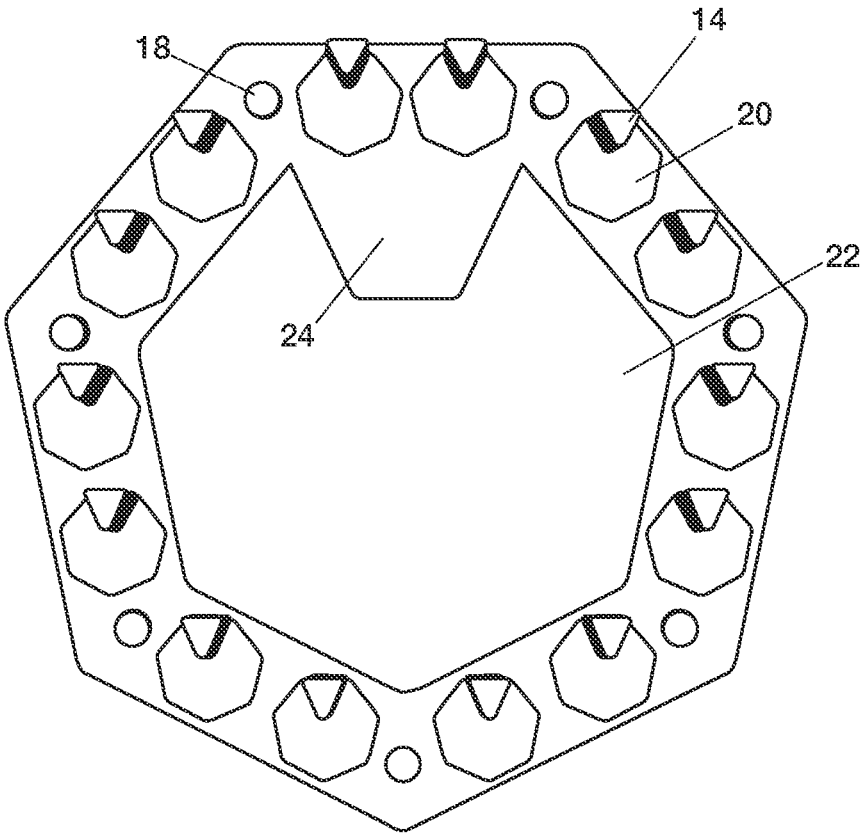
FIG. 11 is a bottom perspective view of the tray elements introduced in FIG. 9.

Referring now to the drawings in general and FIGS. 1 and 9 in particular, it will be understood that the illustrations are for the purpose of describing embodiments of the disclosure and are not intended to limit the disclosure or any inventions thereto. As best seen in FIG. 1, a medication dispensing system 10 and 110 is shown embodied according to the present disclosure for layering single-dose medication packing and labeling. The devices, systems, and methods herein provide visual reminders and organized dispensing patterns. The medication dispensing system 10 and 110 includes a plurality of trays 30, 300, respectively, each having an arrangement of dosage complexes of prepackaged medications correlating to weekly dosage configurations. As introduced in FIG. 1, the medication dispensing system 10 orients the trays 30 in a layer-able fashion, for instance for assembling and providing a visual understanding of medication in a particular regimen, for instance the layered single dose trays mimic a multi-dose packaging, while providing proper labeling compliance for each single-dose medication. Unlike traditional systems and methods, the layered trays 30 and 300 herein may be separated and re-layered, for instance to remove particular medication dosages. Further, additional tray(s) 30 and 300 supporting new medications may be fastened to the medication dispensing system 10, 110.

FIG. 1 shows an embodiment of the medication dispensing system 10 supporting one single dose medication tray 30. In this arrangement, the tray 30 includes a first dosage complex grouping 16*a*, a second dosage complex grouping 16*c*, a third dosage complex grouping 16*b*, and a fourth dosage complex grouping 16*d* arranged around a label platform. Each of the dosage complexes in the single dose medication tray 30 includes a unitary blister pocket 14 adjacent to its respective opening 20. Similarly, the label platform with typically includes a label face 24*a* with medication and/or patient narratives adjacent to an exposed portion 22. A fastener 18 may removably fasten any of the layered trays shown and described herein. Typically, the tray has a thin profile, and in certain examples the tray is plastic molded or the like.

In particular examples, the dosage complex includes four quadrants each representing an available location to support a single-dose medication. In some examples, as shown in FIG. 1, the blister pocket 14 may be positioned in one quadrant, for instance the upper left quadrant. In this example, an L-shaped opening 20 may comprise all remaining quadrants adjacent to the blister pocket 14, for instance the L-shaped opening 20 spans the bottom-left, bottom-right, and top-right quadrants. Those of ordinary skill in the art having the benefit of this disclosure will recognize a variety of other quadrant and geometric configurations. The prepackaged dosage pockets may be a plastic bubble, or the like, protruding through the tray. Further, the blister pockets may extend from a top face of the tray and, in certain examples, be equally-sized rectangular prisms of transparent plastic, or the like.

Figure 2:
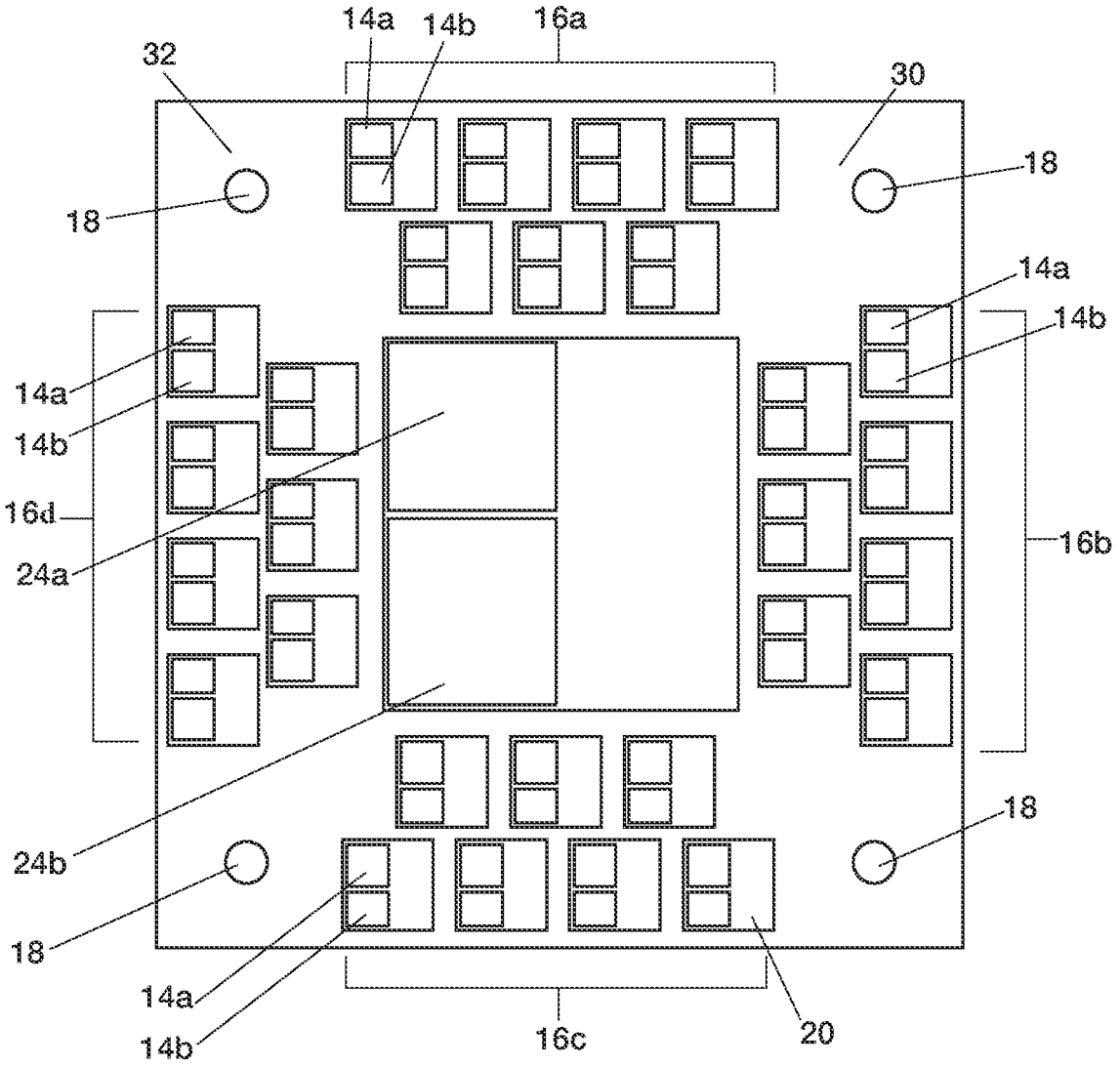
FIG. 2 is a front schematic view of a dispensing system having two single dose trays according to an embodiment of the disclosure.
Figure 3:
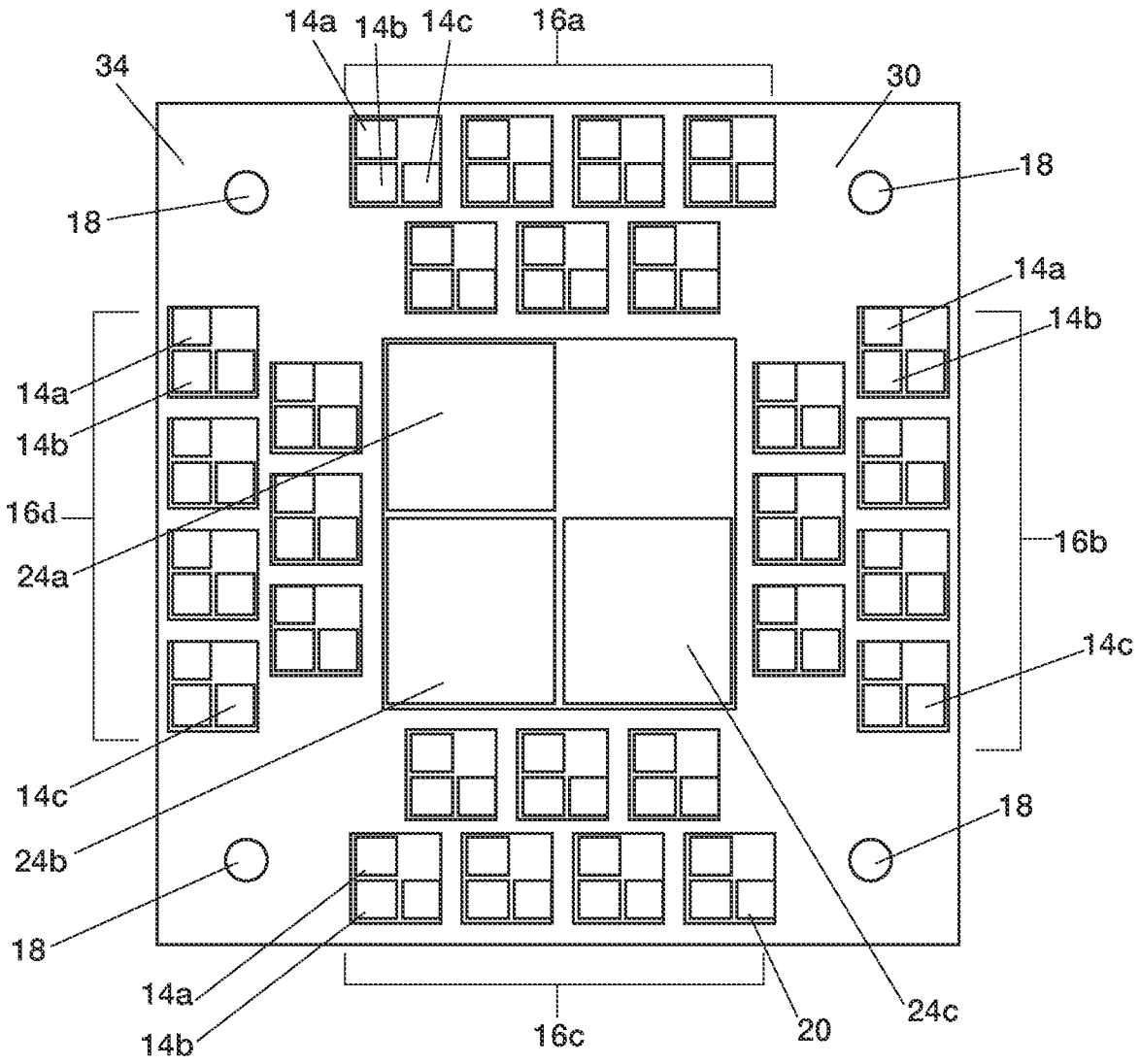
FIG. 3 is a front schematic view of a dispensing system having three single dose trays according to an embodiment of the disclosure.
Figure 4:
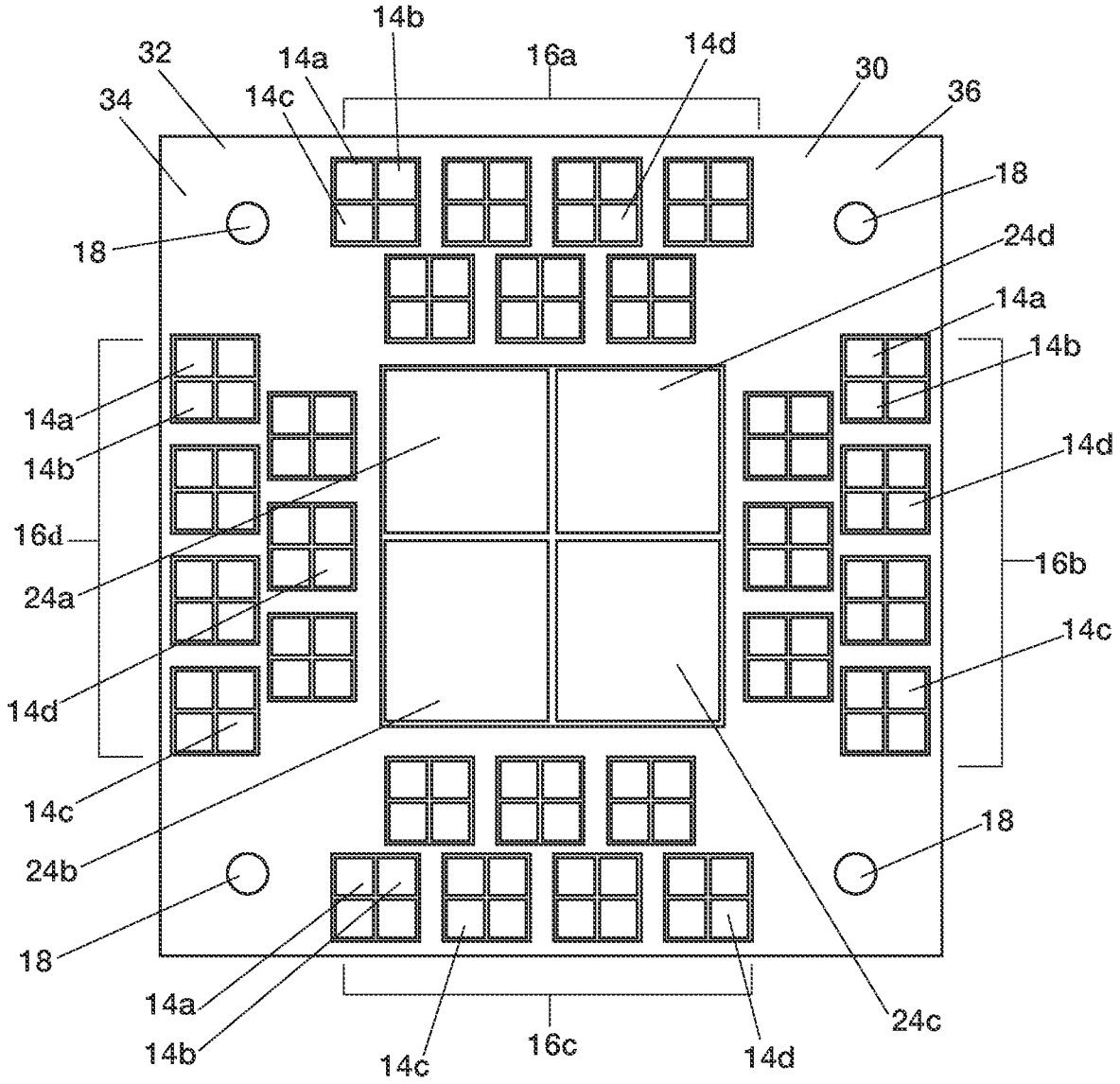
FIG. 4 is a front schematic view of a dispensing system having four single dose trays according to an embodiment of the disclosure.

As shown in FIGS. 2-4, the medication dispensing system 10 may include additional trays removably layered in a symmetrical fashion about one another to create a variety of dynamic, i.e. interchangeable, removable, and the like, medication dosage dispensing systems. In this symmetrical fashion, the area that each dosage complex occupies may be identical when each particular tray is rotated 90, 180, or 270 degrees, respectively, when looking at the face of the tray as shown and described herein. For instance, as illustrated in FIG. 2, a second tray 32 may protrude through a first tray 30 (i.e. through any of the opening and exposed portions) to interface in an interconnected module. In this example, the second tray 32 is aligned substantially ninety degrees from the first tray 30. Further, as shown in FIG. 3, a third tray 34 may be aligned substantially ninety degrees from the second tray 32 to create a layering of three single dose medication interconnected module. Still further, as shown in FIG. 4, a fourth tray 36 may be aligned substantially ninety degrees from the third tray 34 to create a layering of four single dose medication interconnected module.

FIGS. 1-4 illustrates tray(s) having twenty eight prepackaged dosage pockets 14. In these examples, the dosage pockets 14 are separated into four groupings along each side of the tray 30 to represent weekly configurations. For instance, each grouping includes seven prepackaged dosage pockets, each representing a day of the week for when the medication is to be taken. Each dosage complex grouping may thereby represent a week's worth of multiple single dose medications for a patient. Certain examples include trays with less or more than twenty eight medications. Those of ordinary skill in the art having the benefit of this disclosure will recognize a variety of other arrangements.

In addition, FIGS. 1-4 show a label platform on each tray having a label face 24 and an exposed portion 22 to address labeling compliance, while allowing the trays to protrude through one-another as shown and described herein. In particular examples, the label platform includes four quadrants and the label face 24 occupies one quadrant, for instance the upper left quadrant. In this example, an L-shaped exposed portion 22 may span all remaining quadrants adjacent to the label face 24, for instance the L-shaped exposed portion 22 spans the bottom-left, bottom-right, and top-right quadrants to allow three corresponding trays to protrude through one-another into the module. Those of ordinary skill in the art having the benefit of this disclosure will recognize a variety of other quadrant and geometric configurations.

Figure 5:
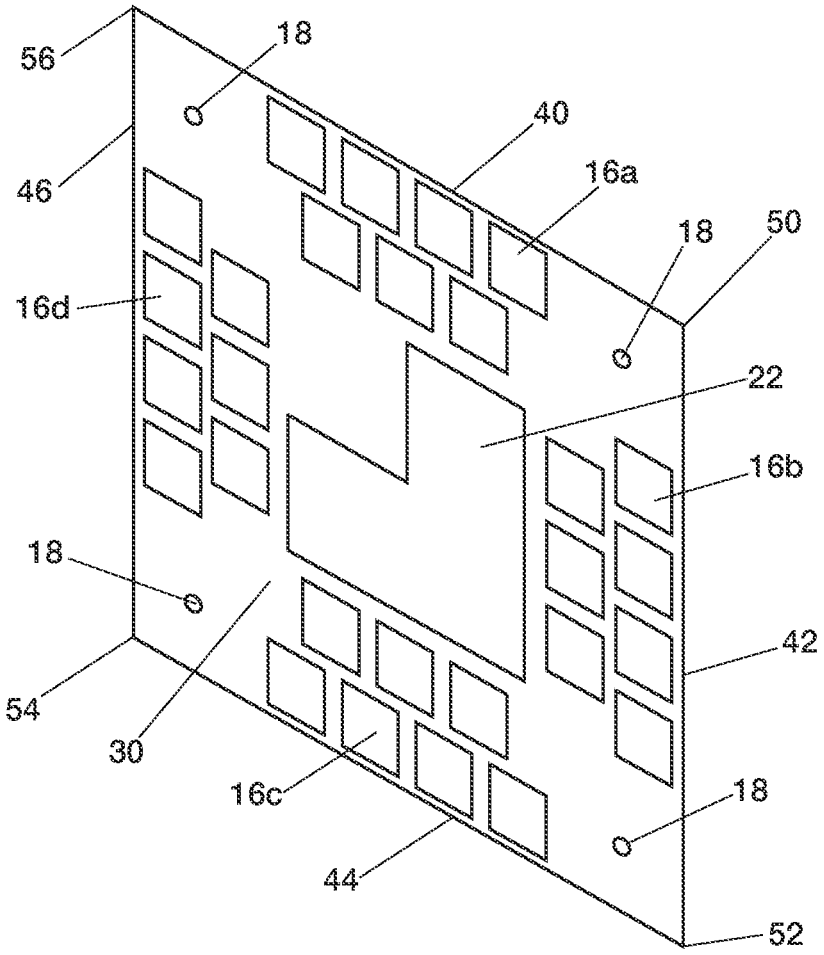
FIG. 5 is a side perspective view of the tray elements introduced in FIG. 1.

FIG. 5 illustrates particular elements of one example of a tray 30. As shown, the tray may include a rear face 50 and an opposing front face 46. The trays may include four corners 50-56 that are temporarily aligned and removable from corresponding corners on opposing trays in any of the assembled modules shown and described herein.

Figure 6:
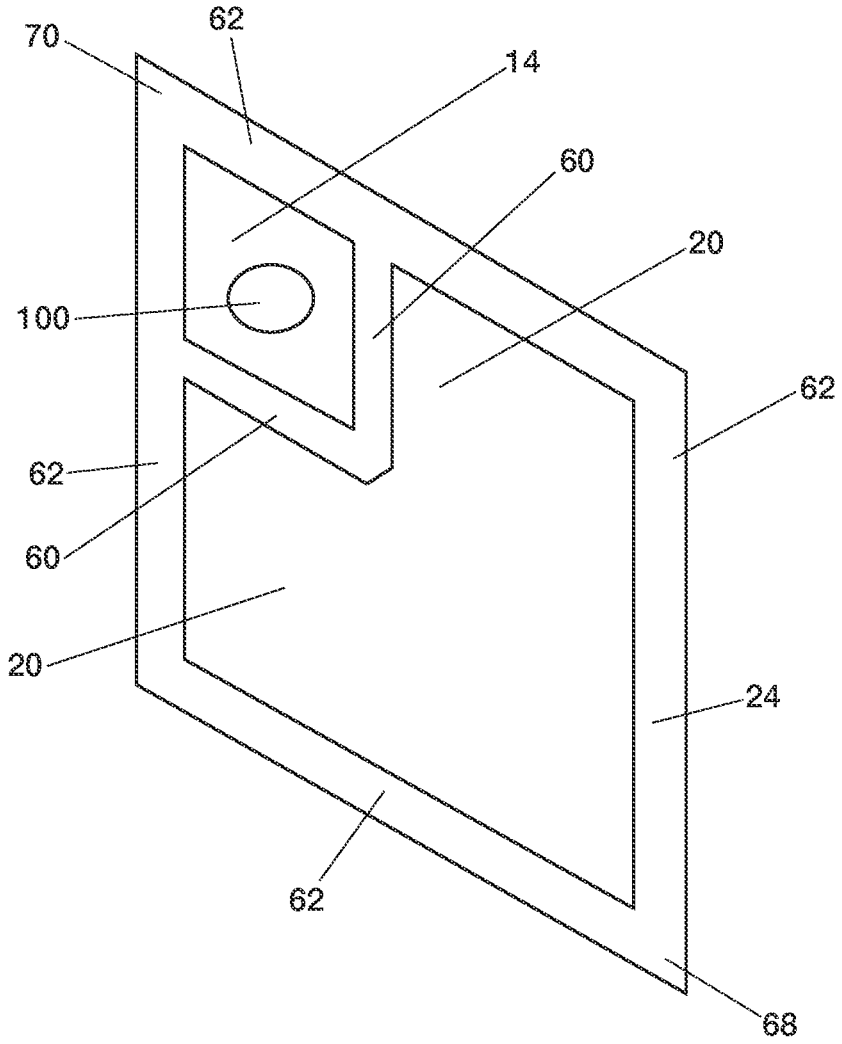
FIG. 6 is an isolated side perspective view of one example of a single dose regimen assembly according to the embodiment introduced in FIG. 1.
Figure 7:
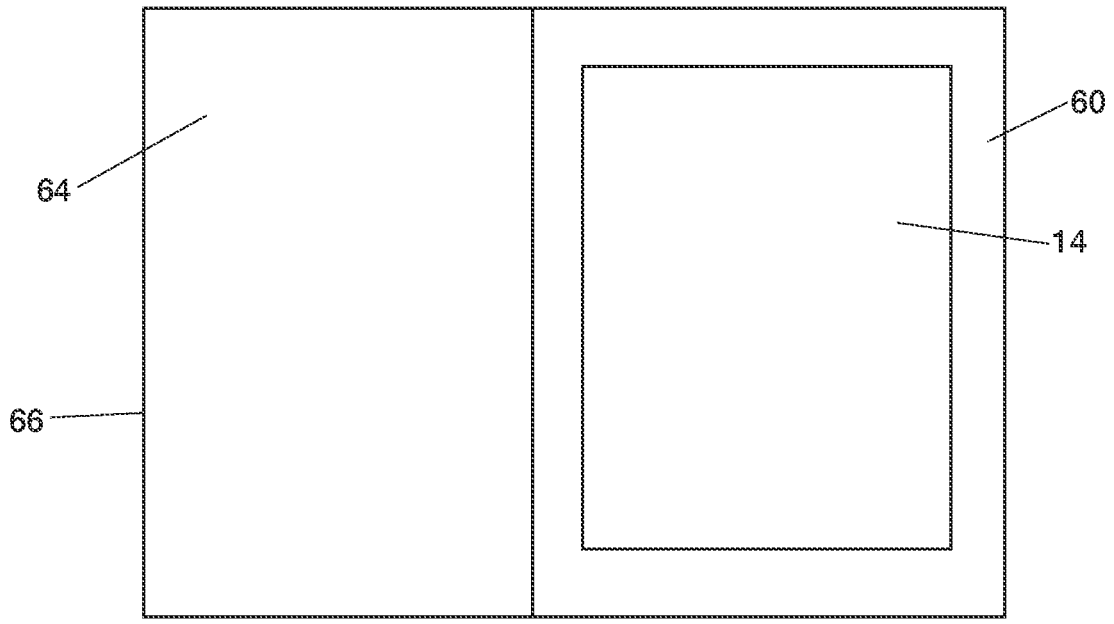
FIG. 7 is an isolated side perspective view of one example of a blister pocket according to an embodiment of the disclosure.

FIG. 6 shows particular elements of one example of a dosage complex. For instance, any of the dosage complexes shown and described herein may include a proximate corner 70 opposite a distal corner 68. The proximate corner 70 is typically adjacent to the label face. Further, the dosage complex may include an outer wall 62 and the pocket blister 14 may include an inner raised wall 60, 64. As further shown in FIG. 6, the pocket blister 14 typically temporarily secures a single dose medication 100. The single dose medication 100 may be a solid, semi-solid, or the like oral medication. Those of ordinary skill in the art having the benefit of this disclosure will recognize a variety of other medications and arrangements. For instance, the blister pocket 14 may have an opening that is substantially flush with a rear face of the tray. As additionally shown in FIG. 4, a punctureable seal 66 may temporarily seal the opening. The seal 66 may comprise foil, paper backing, or the similar sealing material, whereby depressing the dosage pocket from the front side will cause the medication, or the like, to puncture the rear foil/paper seal so that the medication is removed from the tray.

Figure 8:
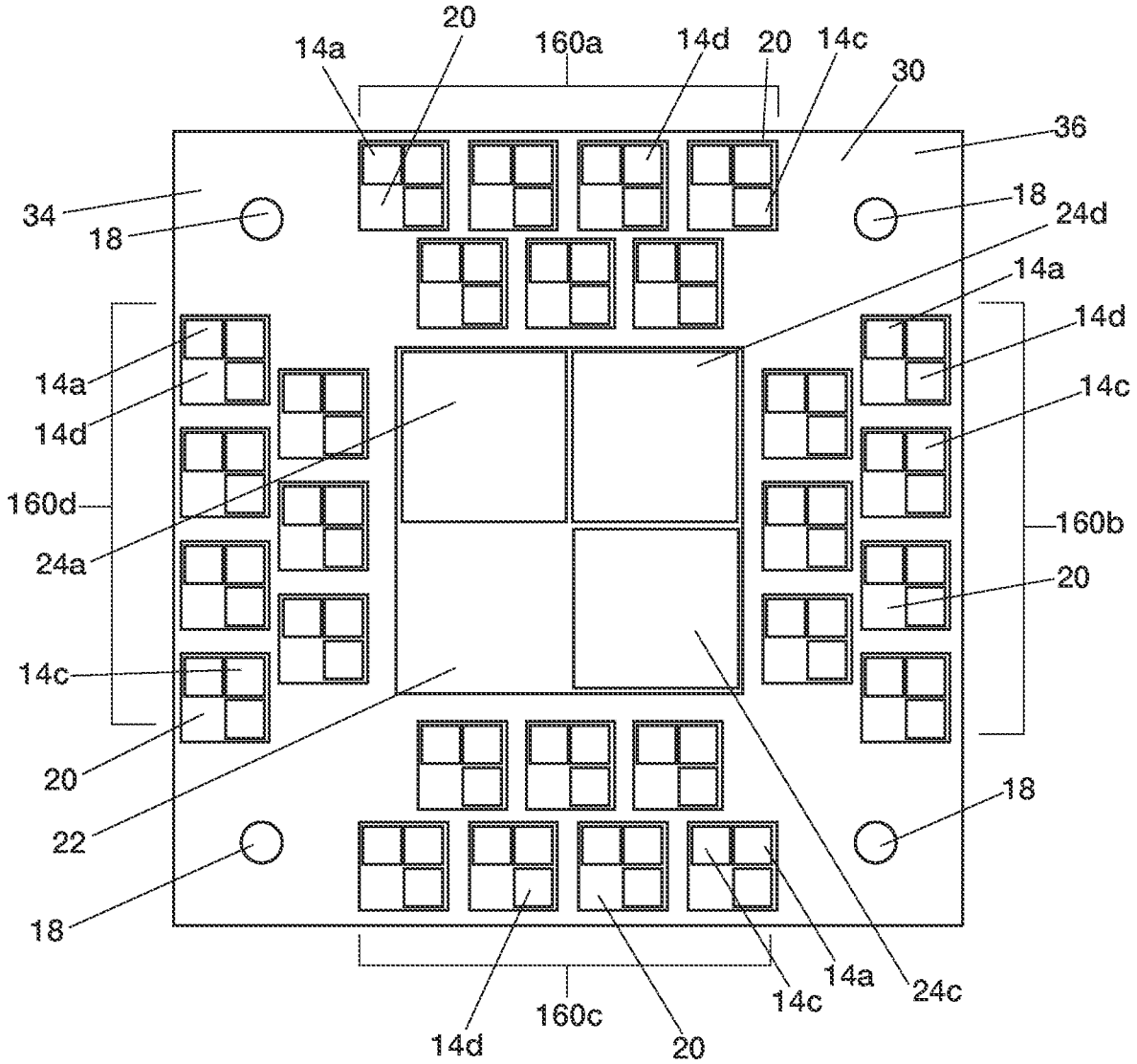
FIG. 8 is a front schematic view of a dispensing system shown in FIG. 4 with one single dose tray removed according to an embodiment of the disclosure.

FIG. 8 introduces an alternative embodiment of the medication dispensing system 110 supporting one single dose medication tray 300. In this arrangement, the tray 300 includes a plurality of dosage complexes arranged around a label platform. Each of the dosage complexes in the single dose medication tray 300 includes a unitary blister pocket 14 adjacent to its respective opening 20. Similarly, the label platform with typically includes a label face **24*a* with medication and/or patient narratives adjacent to an exposed portion 22. A fastener 18** may removably fasten any of the layered trays shown and described herein. Typically, the tray has a thin profile, and in certain examples the tray is plastic molded or the like.

In particular examples, the dosage complex includes alignment each representing an available location to support a single-dose medication. In some examples, as shown in FIG. 1, the blister pocket 14 may be positioned in one quadrant, for instance the upper left quadrant. In this example, an L-shaped opening 20 may comprise all remaining quadrants adjacent to the blister pocket 14, for instance the L-shaped opening 20 spans the bottom-left, bottom-right, and top-right quadrants. Those of ordinary skill in the art having the benefit of this disclosure will recognize a variety of other quadrant and geometric configurations. The prepackaged dosage pockets may be a plastic bubble, or the like, protruding through the tray. Further, the blister pockets may extend from a top face of the tray and, in certain examples, be equally-sized rectangular prisms of transparent plastic, or the like.

As shown in FIGS. 2-4, the medication dispensing system 10 may include additional trays removably layered in a symmetrical fashion about one another to create a variety of dynamic, i.e. interchangeable, removable, and the like, medication dosage dispensing systems. In this symmetrical fashion, the area that each dosage complex occupies may be identical when each particular tray is rotated 90, 180, or 270 degrees, respectively, when looking at the face of the tray as shown and described herein. For instance, as illustrated in FIG. 2, a second tray 32 may protrude through a first tray 30 (i.e. through any of the opening and exposed portions) to interface in an interconnected module. In this example, the second tray 32 is aligned substantially ninety degrees from the first tray 30. Further, as shown in FIG. 3, a third tray 34 may be aligned substantially ninety degrees from the second tray 32 to create a layering of three single dose medication interconnected module. Still further, as shown in FIG. 4, a fourth tray 36 may be aligned substantially ninety degrees from the third tray 34 to create a layering of four single dose medication interconnected module.

FIGS. 1-4 illustrates tray(s) having twenty eight prepackaged dosage pockets 14. In these examples, the dosage pockets 14 are separated into four groupings along each side of the tray 30 to represent weekly configurations. For instance, each grouping includes seven prepackaged dosage pockets, each representing a day of the week for when the medication is to be taken. Each dosage complex grouping may thereby represent a week's worth of multiple single dose medications for a patient. Certain examples include trays with less or more than twenty eight medications. Those of ordinary skill in the art having the benefit of this disclosure will recognize a variety of other arrangements.

In addition, FIGS. 1-4 show a label platform on each tray having a label face 24 and an exposed portion 22 to address labeling compliance, while allowing the trays to protrude through one-another as shown and described herein. In particular examples, the label platform includes four quadrants and the label face 24 occupies one quadrant, for instance the upper left quadrant. In this example, an L-shaped exposed portion 22 may span all remaining quadrants adjacent to the label face 24, for instance the L-shaped exposed portion 22 spans the bottom-left, bottom-right, and top-right quadrants to allow three corresponding trays to protrude through one-another into the module. Those of ordinary skill in the art having the benefit of this disclosure will recognize a variety of other quadrant and geometric configurations.

In some examples, a frame may secure any of trays shown and described herein. The frame may partially or fully enclose any of the corners and edges of the respective trays in any of the assembled modules herein. Further, the frame is typically removable to allow access to the assembled trays for removing and/or adding additional trays to the module. Still further, the frame may have a patient and medication description area to support medication compliance.

In use, medications are presented to a user such that the user would know to take each of those medications from each tray at the same time. Trays may detach from each other if the user desires in order to remove a medication from the system, for instance when medication dosage changes and/or when a medication is discontinued as illustrated in FIG. 8 with the removal of tray 32 from the example shown in FIG. 4.

In other embodiments, the disclosure includes a medication dosage kit. The kit may provide one more trays, e.g. any of the dosage complexes and label platform elements and examples previously shown or described. Further, the kit may include a frame, e.g. any of the frame elements and examples previously shown or described.

Numerous characteristics and advantages have been set forth in the foregoing description, together with details of structure and function. Many of the novel features are pointed out in the appended examples and claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A multidose medication dispensing system comprising:

a first single dose tray having a plurality of dosage complexes and a first label face, wherein each of said plurality of dosage complexes having a unitary blister pocket adjacent to an alignment opening; and at least a second single dose tray having a plurality of dosage complexes and a second label face, wherein each of said dosage complexes having a unitary blister pocket adjacent to an alignment opening, and wherein said first tray includes a bottom surface and said second tray includes an upper surface, and wherein said second tray's upper surface protrudes through said first tray's bottom surface to interface in a plurality of removably layered interconnected modules to define a multi-dose packaging.

2. The system of claim 1, wherein said first tray's unitary blister pocket being a first dimension and said second tray's unitary blister pocket being a second dimension distinct from said first dimension.

3. The system of claim 2, wherein said unitary blister pocket being adjacent to an independent sized alignment opening.

4. The system of claim 1, wherein said unitary blister pocket being adjacent to an L-shaped alignment opening.

5. The system of claim 4, wherein said second tray being aligned substantially ninety degrees from said first single dose tray in said interconnected module.

6. The system of claim 1, further including a third single dose tray having a plurality of dosage complexes and a third label face.

7. The system of claim 1, further including a fourth single dose tray having a plurality of dosage complexes and a fourth label face.

8. The system of claim 1, wherein said first tray's blister pocket includes a first single dose medication and said second tray's blister pocket includes a second single dose medication distinct from said first dose medication.

9. The system of claim 1, wherein said dosage complex includes an outer wall and said pocket blister includes an inner wall.

10. The system of claim 1, wherein said first tray and said second tray each include four groupings of dosage complexes adapted to correspond to a seven day week regimen.

11. The system of claim 1, wherein said first tray and said second tray each include groupings of dosage complexes adapted to correspond to a fourteen day regimen.

12. The system of claim 1, wherein said label face being adjacent to an exposed portion.

13. The system of claim 1, including a frame having a patient and medication description area.

* * * * *